US005101526A

United States Patent [19]

Smith

[11] Patent Number: 5,101,526

[45] Date of Patent: Apr. 7, 1992

[54] ADJUSTABLE FOOT SUPPORT APPARATUS

[76] Inventor: Sharon D. Smith, 6260 Palm Ave., San Bernadino, Calif. 92407

[21] Appl. No.: 745,189

[22] Filed: Aug. 15, 1991

[51] Int. Cl.[5] ..... A47C 21/00; A47C 21/04

[52] U.S. Cl. ..... 5/630; 5/421

[58] Field of Search ..... 5/443, 444, 80, 431, 5/421, 505, 506; 128/892, 893, 894

[56] References Cited

U.S. PATENT DOCUMENTS

| | | | |
|---|---|---|---|
| 667,260 | 2/1901 | Stetson | 5/444 |
| 931,908 | 8/1909 | Weld | 5/444 |
| 1,694,095 | 12/1928 | Du Moulin | 5/444 |
| 2,952,855 | 9/1960 | Zuti | 5/444 |
| 2,986,747 | 6/1961 | Posey | 5/444 |
| 3,021,837 | 2/1962 | Newell | 5/444 |
| 3,086,225 | 4/1963 | Fillingim | 5/444 |
| 3,967,334 | 7/1976 | Ricke et al. | 5/444 |

FOREIGN PATENT DOCUMENTS

| | | | |
|---|---|---|---|
| 575206 | 2/1946 | United Kingdom | 5/444 |

*Primary Examiner*—Alexander Grosz
*Attorney, Agent, or Firm*—Leon Gilden

[57] ABSTRACT

A mattress plate is positioned below a mattress, with side walls extending upwardly from the mattress plate to secure a foot support insert therebetween in an adjustable manner utilizing a central support shaft and a plurality of cross pins, with a cross pin directed into the insert from each side wall of the mattress plate. The insert includes a plurality of foot support sockets, with the sockets optionally including pneumatic chambers and heating members, as well as a vibratory device to enhance circulation and comfort in use of the organization.

7 Claims, 6 Drawing Sheets

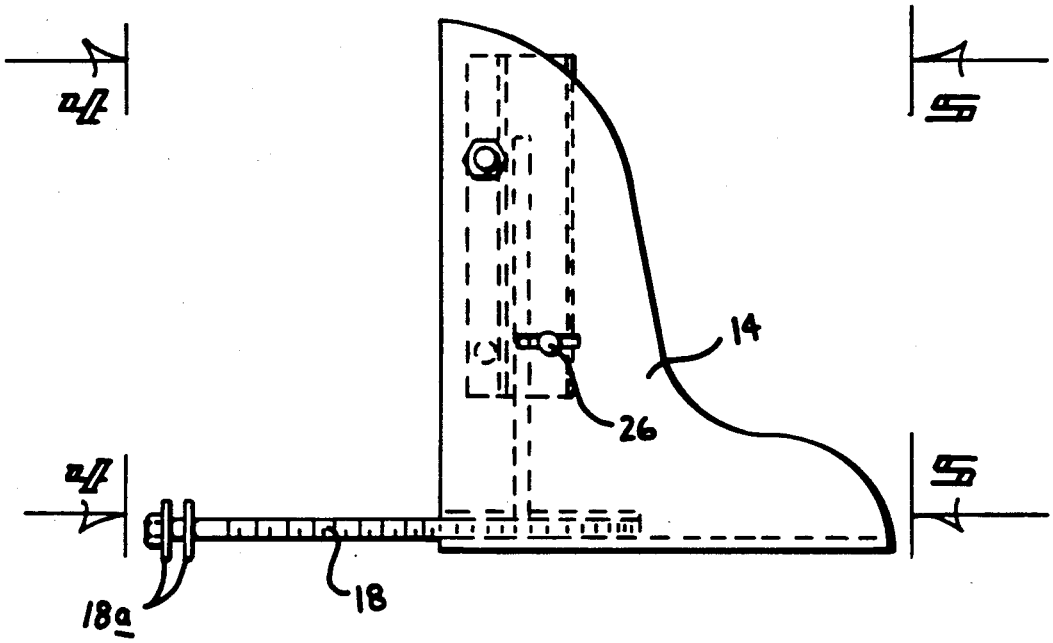
FIG 3
FIG 4
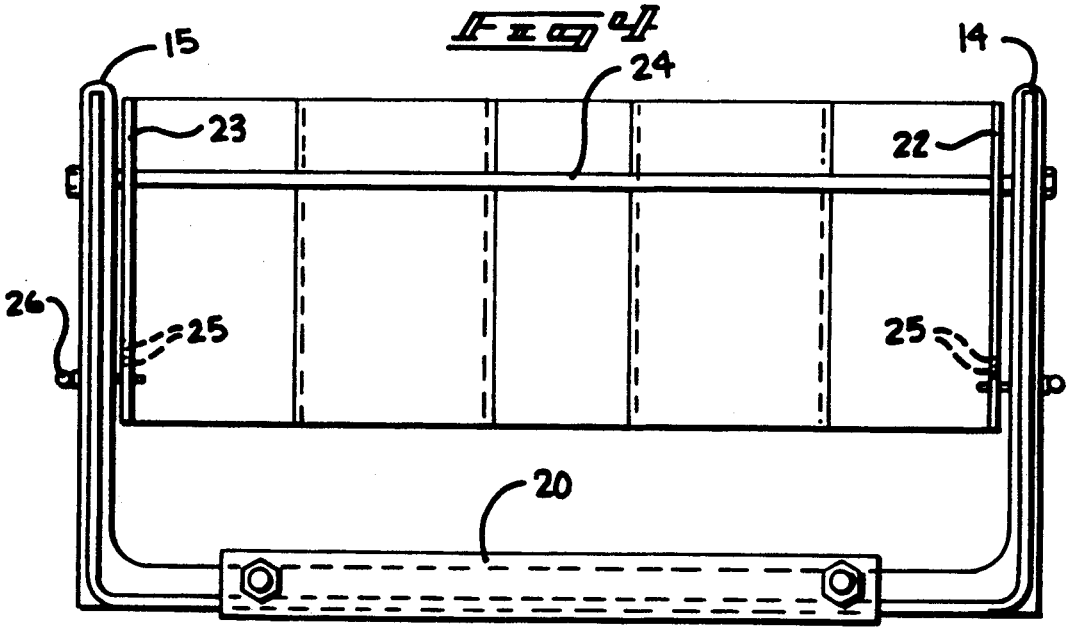

ADJUSTABLE FOOT SUPPORT APPARATUS

BACKGROUND OF THE INVENTION

1. Field of the Invention

The field of invention relates to bed accessories, and more particularly pertains to a new and improved bed and foot support apparatus wherein the same is arranged in association with a bed to provide comfort and selective elevation to the feet of an individual within the bed.

2. Description of the Prior Art

Various devices are utilized in the prior art to position an individual's feet in various orientations within a bed for therapeutic as well as for comfort purposes. Such apparatus is exemplified in U.S. Pat. No. 3,967,334 to Ricke, et al. wherein a hospital bed includes a foot board arranged for mounting on opposed rails of an associated bed to provide support and positioning of the feet of a bed-ridden individual.

U.S. Pat. No. 3,345,654 to Noble sets forth a support cradle for mounting an individual's feet in a horizontal orientation.

U.S Pat. No. 4,841,589 to Moore sets forth a bed cover structure to Provide covering over a selected area of a patient's body.

U.S. Pat. No. 3,803,645 to Oliverius sets forth an inflatable foot support for use in hospital beds and engageable by the feet of an individual within the bed to substantially restrict internal and external orientation of the feet when mounted to the bed.

As such, it may be appreciated that there continues to be a need for a new and improved bed and foot support apparatus as set forth by the instant invention which addresses both the Problems of ease of use as well as effectiveness in construction in mounting within a lowermost end portion of a bed to position and secure an individual's feet thereon and in this respect, the present invention substantially fulfills this need.

SUMMARY OF THE INVENTION

In view of the foregoing disadvantages inherent in the known types of foot support apparatus now present in the prior art, the present invention provides a bed and foot support apparatus wherein the same is arranged for mounting an individual's feet for comfort and therapeutic elevation in use. As such, the general purpose of the present invention, which will be described subsequently in greater detail, is to provide a new and improved bed and foot support apparatus which has all the advantages of the prior art foot support apparatus and none of the disadvantages.

To attain this, the present invention provides a mattress plate positioned below a mattress, with side walls extending upwardly from the mattress plate to secure a foot support insert therebetween in an adjustable manner utilizing a central support shaft and a plurality of cross pins, with a cross pin directed into the insert from each side wall of the mattress plate. The insert includes a plurality of foot support sockets, with the sockets optionally including pneumatic chambers and heating members, as well as a vibratory device to enhance circulation and comfort in use of the organization.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bed and foot support apparatus which has all the advantages of the prior art foot support apparatus and none of the disadvantages.

It is another object of the present invention to provide a new and improved bed and foot support apparatus which may be easily and efficiently manufactured and marketed.

It is a further object of the present invention to provide a new and improved bed and foot support apparatus which is of a durable and reliable construction.

An even further object of the present invention is to provide a new and improved bed and foot support apparatus which is susceptible of a low cost of manufacture with regard to both materials and labor, and which accordingly is then susceptible of low prices of sale to the consuming public, thereby making such bed and foot support apparatus economically available to the buying Public.

Still yet another object of the present invention is to provide a new and improved bed and foot support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic side view of the instant invention.

FIG. 4 is an orthographic rear view of the instant invention.

DESCRIPTION OF THE PREFERRED EMBODIMENT

Figure 1:
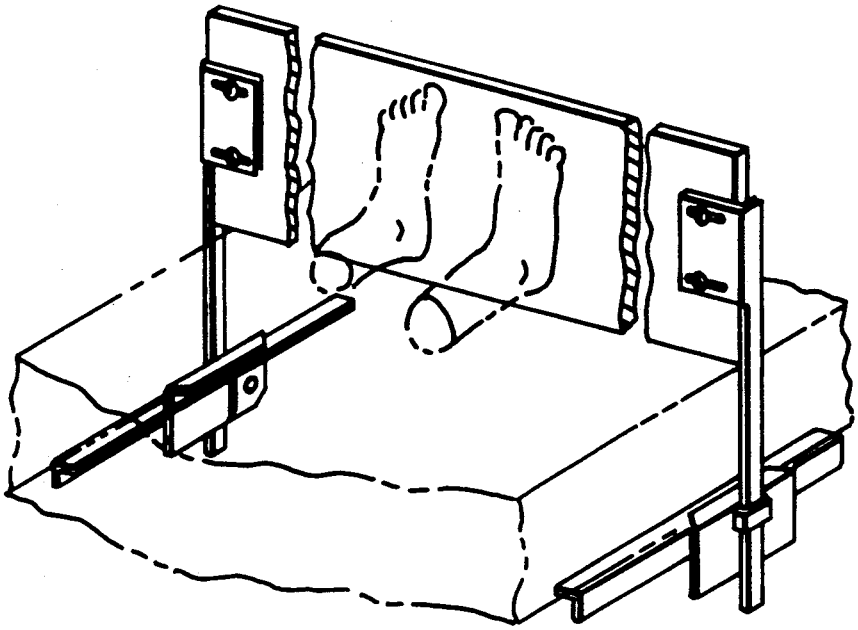
Fig 1 PRIOR ART
FIG. 1 is an isometric illustration of a prior art bed foot support apparatus.

With reference now to the drawings, and in particular to FIGS. 1 to 11 thereof, a new and improved bed and foot support apparatus embodying the principles and concepts of the present invention and generally designated by the reference numeral 10 will be described.

Figure 2:
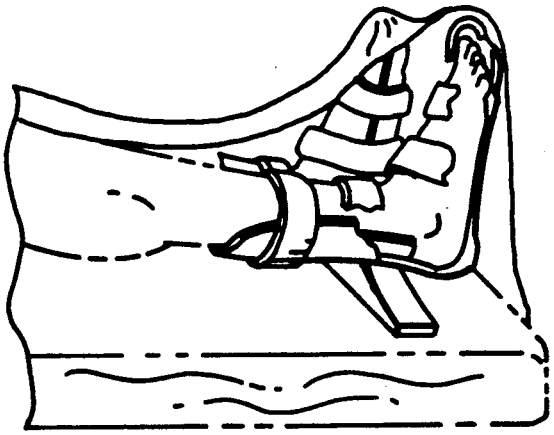
Fig 2 PRIOR ART
FIG. 2 is an isometric illustration of a further prior art foot support apparatus.
Figure 6:
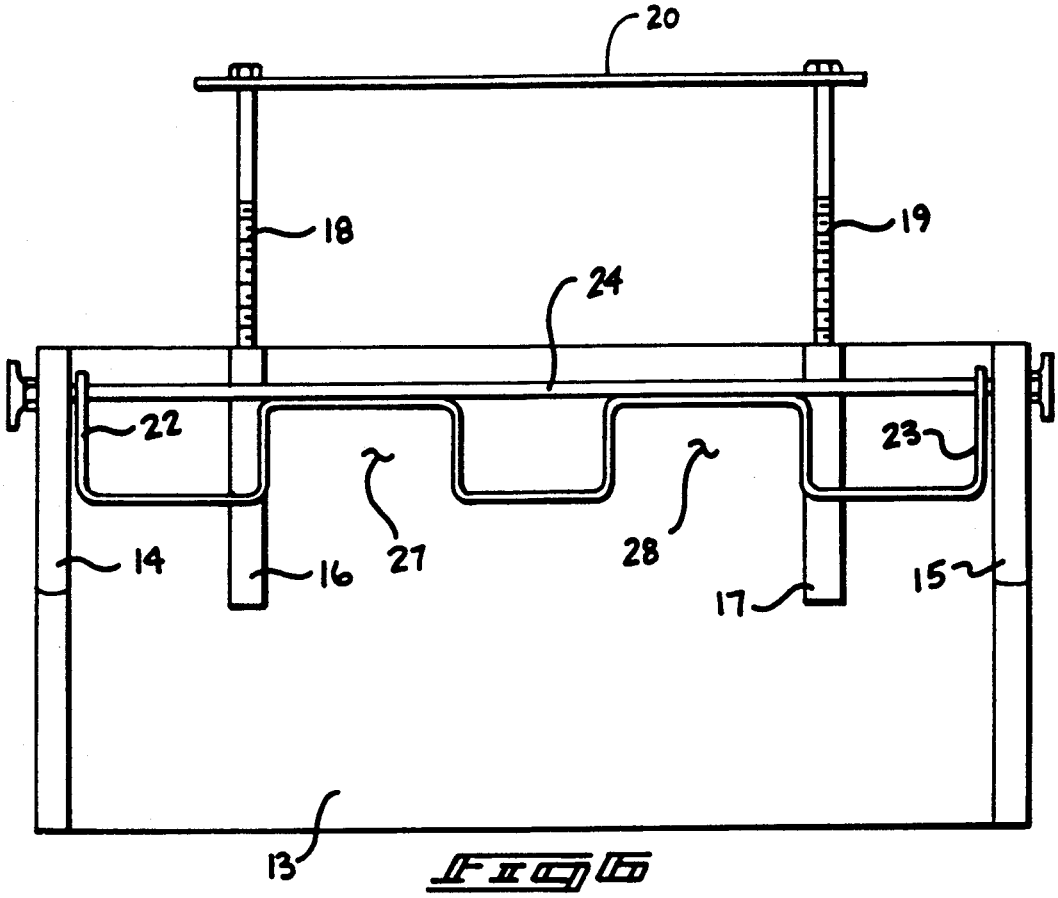
FIG. 6 is an orthographic top view of the instant invention.
Figure 5:
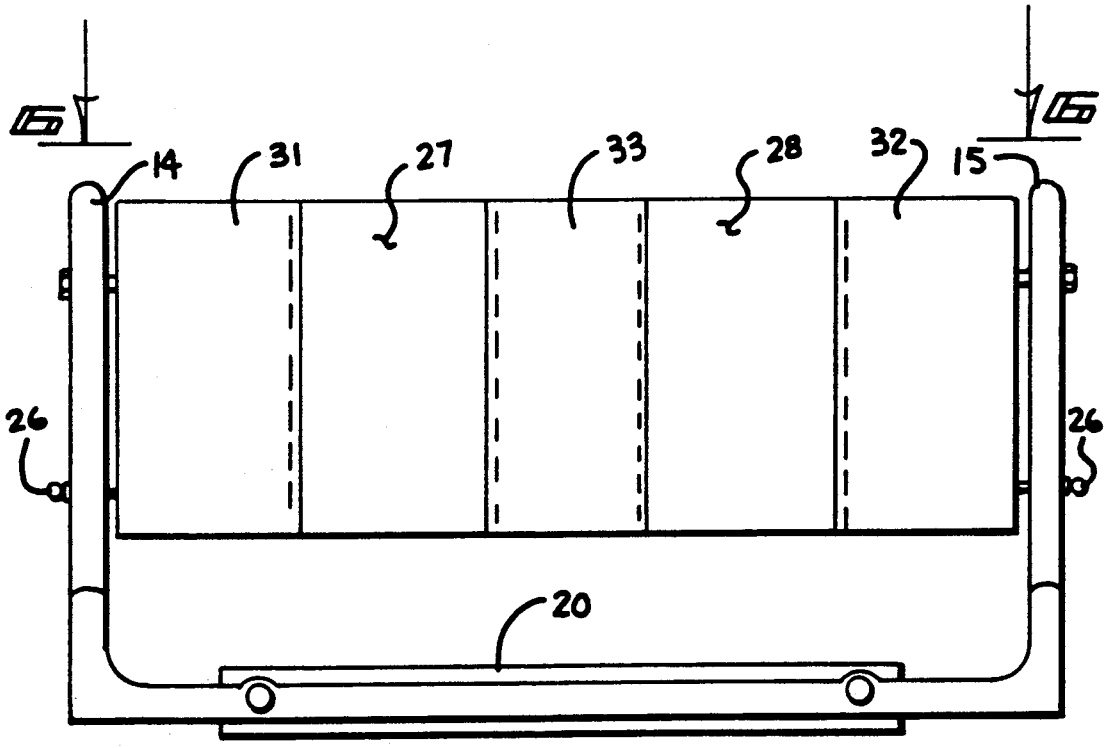
FIG. 5 is an orthographic front view, taken in elevation, of the invention.
Figure 7:
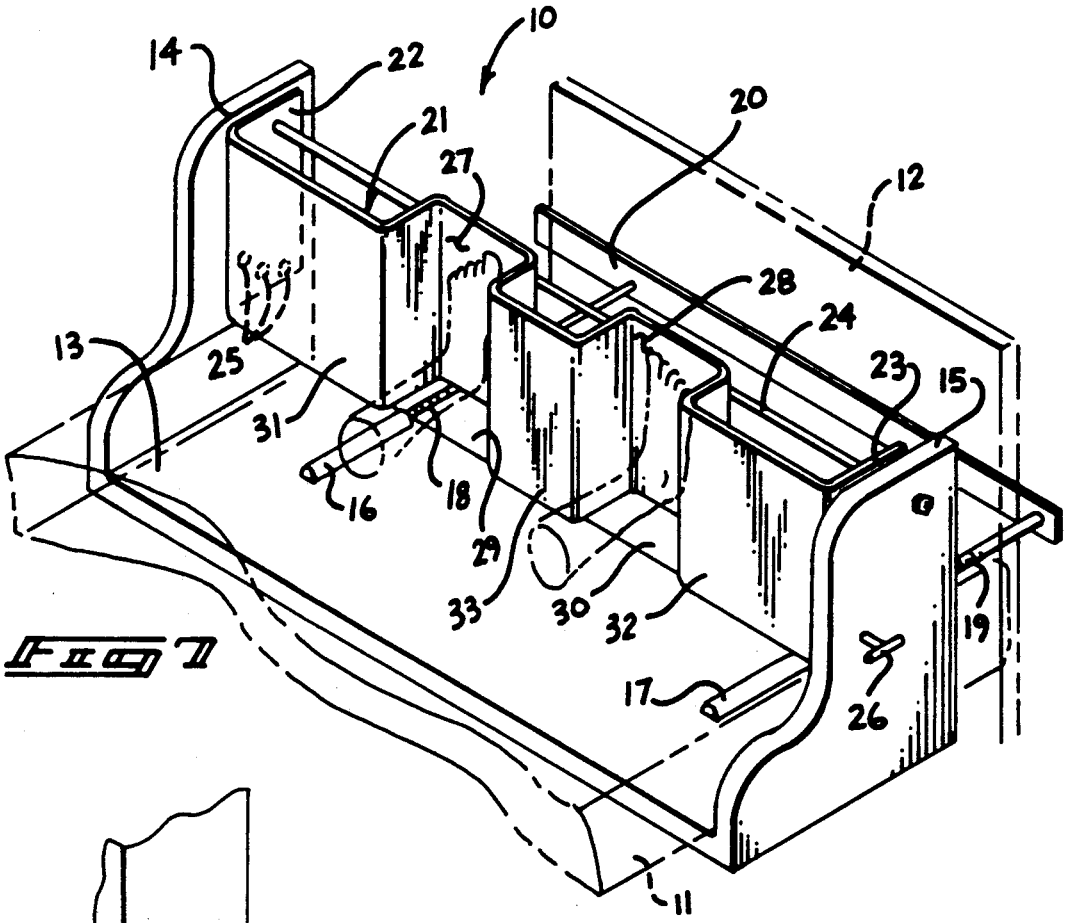
FIG. 7 is an isometric illustration of the instant invention.
Figure 8:
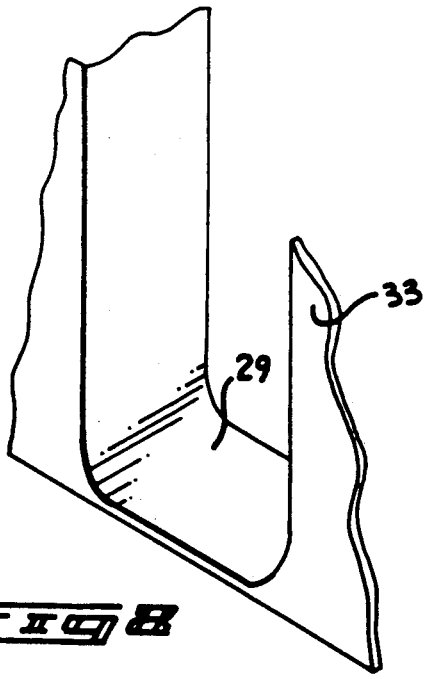
FIG. 8 is an isometric illustration of the instant invention utilizing a floor plate.
Figure 9:
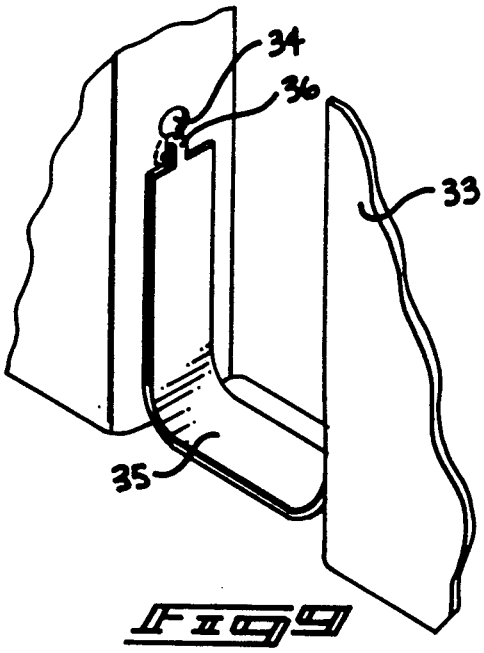
FIG. 9 is an isometric illustration of a foot support socket of the invention utilizing a flexible web in lieu of a floor portion.

FIG. 1 illustrates a prior art bed foot board assembly, as set forth in U.S. Pat. No. 3,967,334, that adjustably mounts a foot board in a vertical and horizontal orientation relative to an underlying mattress. FIG. 2 illustrates a further Prior art structure, as presented in U.S. Pat. No. 3,345,654, providing a cradle structure to mount the feet of an individual at the lower end portion of a bed structure.

More specifically, the bed and foot support apparatus 10 of the instant invention essentially comprises a conventional mattress 11 mounted upon a bed framework, to include a foot board 12 extending upwardly adjacent the lower terminal end of the mattress, with the organization to include a mattress plate 13 positioned below the mattress and including spaced parallel first and second respective side walls 14 and 15 that are orthogonally mounted to opposed sides of the mattress plate 13. A respective first and second internally threaded socket 16 and 17 is formed within the mattress plate, wherein the sockets are parallel relative to one another and to the side walls and the sockets extending to a rear edge of the mattress plate 13 and to threadedly receive a respective first and second threaded rod 18 and 19 therewithin. The threaded rods 18 and 19 are each rotatably mounted within an abutment plate 20 that is mounted to forward terminal ends of the threaded rods in a spaced relationship relative to the rear edge of the mattress plate for abutment with the foot board 12 to longitudinally position the mattress plate relative to the foot board. FIG. 3 notes the use of the spaced flanges **18*a* mounted at the forward end of the rods to receive the abutment plate 20** therebetween and thereby rotatably mount the threaded rod relative to the abutment plate.

A foot support insert 21 is mounted coextensively between the first and second side walls 14 and 15 and spaced above the mattress plate 13. The insert 21 includes spaced parallel first and second insert flanges 22 and 23 respectively that are spaced apart a predetermined spacing substantially equal to a predetermined spacing defined between interior walls of the first and second side walls 14 and 15. A support shaft 24 extends orthogonally and coextensively through the first and second side walls 14 and 15 in a spaced relationship relative to the mattress plate 13 to mount the foot support insert 21, with the respective first and second side walls 14 and 15 slidably receiving a cross pin 26 removably mounted through each side wall and receivable within one of a plurality of an arcuate array of insert flange openings 25 directed through each insert flange 22 and 23. In this manner, the cross pin 26 is selectively directed through each flange of the flanges 22 and 23 to permit relative pivotal adjustment of the insert 21 about the support shaft 24 for varying the angulation of the insert 21 relative to the mattress plate 13. The insert 21 includes a coplanar first and second front wall 31 and 32 orthogonally mounted adjacent the respective first and second flanges 22 and 23, with a medial front wall 33 oriented medially between the spaced first and second front walls, with a respective first and second foot support socket 27 and 28 projecting orthogonally and rearwardly of the front walls, with each socket including a generally "U" shaped cavity. Optionally, a respective first and second floor 29 and 30 is positioned at a lower terminal end of each foot support socket, as illustrated. Each socket is defined by rigid side walls and an end wall to define a generally "U" shaped cross-sectional configuration, wherein in lieu of the floors 29 and 30, each side wall of each socket may include (see FIG. 9) a support slot 34 to receive a "U" shaped support clip 36 formed at each end of a heel support web belt 35 to permit suspending of the web belt between side walls of each socket to permit positioning of an individual's foot thereon.

Figure 10:
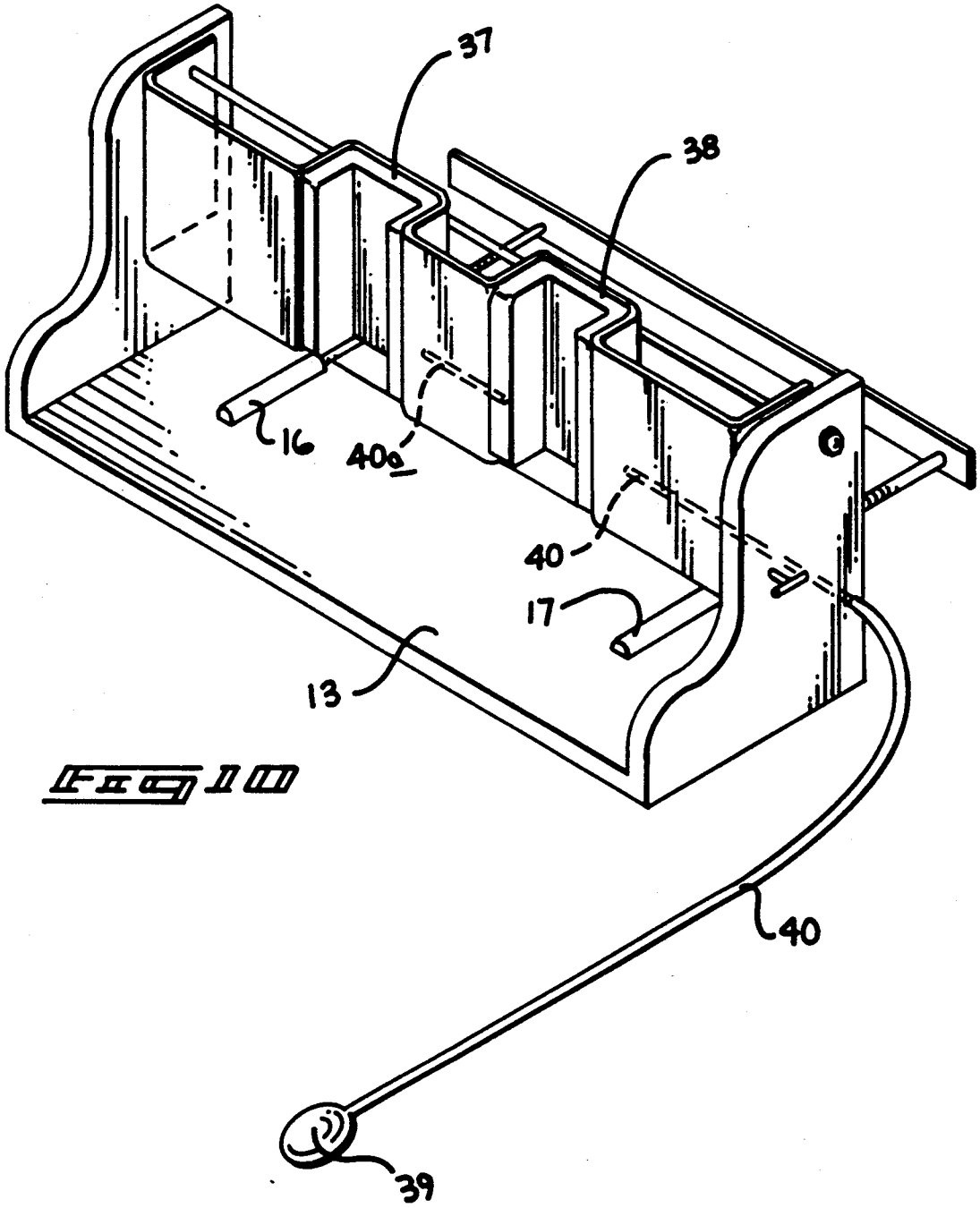
FIG. 10 is an isometric illustration of the invention illustrating the use of pneumatic cushions within the foot support sockets.
Figure 11:
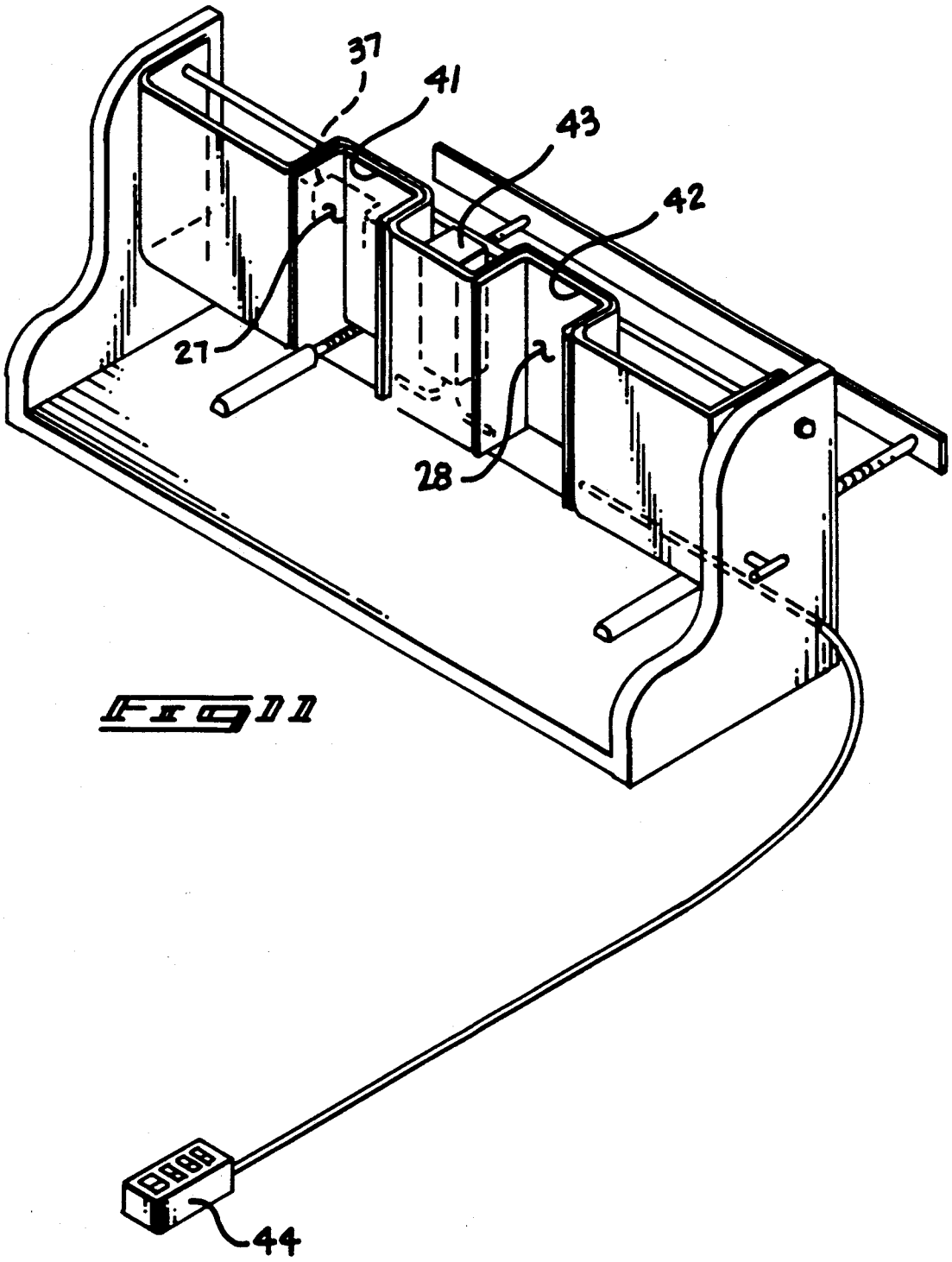
FIG. 11 is an isometric illustration of the invention utilizing a heating chamber, as well as a vibrator in association with the pneumatic chamber structure in the foot support sockets.

FIG. 10 illustrates the use of respective first and second "U" shaped inflation chambers 37 and 38 mounted coextensively within the side walls and end wall of each socket and selectively inflatable through an inflation conduit 40 and an inflation bulb 39. The conduit 40 is directed from the inflation bulb 39 to the second chamber 38 and from the second chamber by a further conduit portion **40*a* to the first inflation chamber 37. FIG. 11 illustrates further use of a respective first and second heating pad mounted coextensively between each inflation chamber and each socket to provide heating of an individual's foot portions therewithin to enhance circulatory flow therethrough, and to this end, a vibrator 43 is mounted medially between each of the sockets within the insert and in fixed communication with each socket to effect vibratory energy directed to each socket to enhance circulation, wherein a control panel 44 is arranged to operatively control the vibrator 43 and the heating pads 41 and 42**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bed and foot support apparatus arranged for securement to a bed to include a mattress and a foot board extending upwardly of the mattress at a lower terminal end of the mattress, the apparatus comprising, a mattress plate for positioning under the mattress adjacent the foot board, with the mattress plate including a respective first and second side edge, and a respective first and second side wall extending upwardly and orthogonally relative to the mattress plate fixedly mounted to the respective first and second side edge, the mattress plate including a first and second internally threaded socket, and the mattress plate including a rear edge directed orthogonally between the first and second side wall and the first and second internally threaded socket arranged parallel relative to one another and the first and second side walls and projecting to the mattress plate rear edge, and the first and second internally threaded socket including a respective first and second externally threaded rod threadly receivable therewithin, the first and second rods including a respective first and second forward terminal end spaced from the mattress plate, and the first and second forward terminal end orthogonally and rotatably mounted to an abutment plate, the abutment plate extending coextensively between the first and second rod, with the abutment plate arranged for abutment against the foot board, with the abutment plate arranged in adjustable spaced relationship relative to the mattress plate, and the first and second side wall defining a predetermined spacing therebetween, and a foot support insert, arranged for positioning over the mattress defined by a predetermined length substantially equal to the predetermined spacing mounted between the first and second side wall, the foot support insert including a first and second foot support socket for receiving a first and second foot of an individual.

2. An apparatus as set forth in claim 1 wherein the foot support insert includes a respective first and second insert flange arranged adjacent the respective first and second side wall, and a support shaft orthogonally directed through the first and second side wall and the first and second flange to mount the foot support insert between the first and second side wall, and the respective first and second flange including a respective first and second arcuate array of insert flange openings, and the first and second insert flanges each including a respective first and second cross pin selectively receivable within an opening of the respective first and second arcuate array of insert flange openings, and the first and second cross pin orthogonally and slidably directed through the respective first and second side wall below the support shaft.

3. An apparatus as set forth in claim 2 wherein the foot support insert includes a planar front wall orthogonally mounted to the first flange, and a second front wall orthogonally mounted to the second flange, wherein the first and second walls are in a spaced coplanar relationship relative to one another, and a medial front wall positioned medially of the front wall and the second wall, with respective first foot support socket positioned between and recessed relative to the first front wall and the medial front wall, and the second foot support socket positioned between and recessed relative to the second front wall and the medial front wall, and each foot support socket includes space side walls and a rear wall to define a "U" shaped cross-sectional configuration.

4. An apparatus as set forth in claim 3 wherein the first and second foot support sockets include a respective first and second floor positioned at a lower terminal end of each foot support socket.

5. An apparatus as set forth in claim 4 wherein each respective first and second foot support sockets includes a respective first and second "U" shaped inflation chamber mounted coextensively in contiguous communication with the first and second foot support socket, and an inflation bulb, the inflation bulb including a first conduit in pneumatic communication between an inflation bulb and the second "U " shaped inflation chamber, and a second conduit in pneumatic communication between the second "U" shaped inflation chamber and the first "U" shaped inflation chamber, whereupon actuation of the inflation bulb effects inflation of the first "U" shaped inflation chamber and the second "Y" shaped inflation chamber.

6. An apparatus as set forth in claim 5 wherein the first and second foot support sockets includes a respective first and second heating pad coextensively mounted between the respective first and second "U" shaped inflation chamber and the first and second "U" shaped socket, and further including a vibrator positioned medially between the first and second foot support socket and rearwardly of the medial front wall, and control means to effect selective actuation of the vibrator and the first and second heating pad.

7. An apparatus as set forth in claim 4 wherein each side wall of each foot support socket includes a support slot, and each foot support socket includes a heel support flexible web belt, each web belt includes a "U" shaped support clip formed at each terminal end of each web belt, wherein the "U" shaped support clip is arranged for reception within a respective support slot within a respective side wall.

* * * * *